US005156098A

United States Patent [19]

Camp

[11] Patent Number: 5,156,098

[45] Date of Patent: Oct. 20, 1992

[54] TWO CHAMBER BURNER APPARATUS FOR DESTROYING WASTE LIQUIDS

[75] Inventor: John D. Camp, Tamball, Tex.

[73] Assignee: William W. Bailey, Miami, Fla. ; a part interest

[21] Appl. No.: 817,359

[22] Filed: Jan. 6, 1992

[51] Int. Cl.[5] ..... F23G 7/04

[52] U.S. Cl. ..... 110/238; 110/186; 110/212; 431/39

[58] Field of Search ..... 110/238, 346, 101 CD, 110/211, 212, 214, 185, 186; 431/39

[56] References Cited

U.S. PATENT DOCUMENTS

| | | | |
|---|---|---|---|
| 3,858,532 | 1/1975 | Jorgensen | 110/238 |
| 3,881,430 | 5/1975 | Katz | 110/346 |
| 4,094,625 | 6/1978 | Wang et al. | 110/238 X |
| 4,453,476 | 6/1984 | Erlandsson | 110/346 |
| 4,557,203 | 10/1985 | Mainord | 110/344 |
| 4,802,423 | 2/1989 | Pennington | 110/233 |
| 4,969,406 | 11/1990 | Buzetzki | 110/341 |

*Primary Examiner*—Edward G. Favors
*Attorney, Agent, or Firm*—Larson & Taylor

[57] ABSTRACT

A burner apparatus provides on-site destruction of waste liquids such as liquid anti-freeze, waste motor oil, and the like independently of the liquid concentration thereof. The apparatus comprises a storage tank for waste liquid including a reservoir and a level sensor for sensing the level of the waste liquid in the reservoir, and a burner unit energized responsive to the level sensor when the level of waste liquid exceeds a predetermined value. The burner unit includes first and second chambers connected together by a flame port provided between the chambers at the bottom of the chambers. An atomizing injector injects waste liquid from the storage tank, in an atomized form, into a flame produced by a first burner located at the top of the first chamber so that combustion products that are produced fall towards the bottom of the first chamber and pass through the flame port into the second chamber. A second burner burns combustion products exiting from the flame port into the second chamber.

25 Claims, 3 Drawing Sheets

TWO CHAMBER BURNER APPARATUS FOR DESTROYING WASTE LIQUIDS

FIELD OF THE INVENTION

The present invention relates to destroying waste liquids such as anti-freeze, waste motor oil and the like and more particularly to apparatus which enables this to be done efficiently and relatively inexpensively.

BACKGROUND OF THE INVENTION

Waste liquids generated at automobile service stations and the like present a serious threat to the environment and as a consequence of the concern about this problem, laws have been passed in many jurisdictions with respect to the manner of disposal of such waste liquids. Liquids that present a particular problem include waste motor oils, anti-freeze and the like, and the varying amount of water contained in such liquids (from about 100% water to about 0%) adds to the difficulty of finding a suitable solution to their disposal. Perhaps the simplest and most commonly used solution presently available is to transport the waste liquids to a large commercial incinerator for burning. However, such an approach is quite costly, particularly with respect to the handling (e.g., loading and unloading) and transporting of the liquid wastes.

There are, of course, many different kinds of burners that are designed to be used for various purposes. Patents relating to burners of possible interest here include U.S. Pat. Nos. 4,802,423 (Pennington); 4,557,203 (Mainord); 4,969,406 (Buzetzki); and 3,881,430 (Katz). The Pennington patent discloses a combustion apparatus including an auxiliary burning unit for liquid wastes. Wastes may be burned in the auxiliary unit by exposure at a sufficiently high temperature for a sufficient time period. The apparatus relies for its operation on the combustibility of the liquid waste being burned. The Mainord patent discloses a reclamation furnace used to reclaim metal parts contaminated with combustible materials by pyrolyzing the combustible materials. The furnace comprises a primary heat-input burner located in a primary heating chamber and an afterburner chamber including a secondary burner. Water sprays are used to provide temperature control. The Buzetzki patent discloses a method for thermal decomposition of a fluid toxic substance carried in a gas. A combustion unit provided for this purpose comprises a main combustion chamber and a secondary combustion chamber. The Katz patent discloses a two-stage incinerator for incinerating waste hydrocarbon oil or similar products. Waste liquids are injected downstream of the burner, and an air fluidized bed is employed.

SUMMARY OF THE INVENTION

In accordance with the invention, a burner apparatus or system is provided which enables, in an economical manner, on-site destruction of waste liquids such as anti-freeze, waste motor oil and like materials in widely varying concentrations from 100% hydrocarbons to 100% water and which thus provides substantial advantages over the costly transporting of such materials to large commercial incinerators.

In accordance with a preferred embodiment, apparatus for providing on-site destruction of waste liquids such as those mentioned above comprises: a storage tank for waste liquid including a reservoir and a level sensing means for sensing the level of the waste liquid in the reservoir, and a burner unit energized responsive to the level sensing means when the level of the waste liquid exceeds a predetermined value. The burner unit includes a first chamber, a second chamber in communication with the first chamber, means disposed at the bottom of the chambers defining a passage (flame port) between the chambers, a first burner located at the top of the first chamber for, when the unit is energized, producing a flame which is projected into the first chamber, injection means for, when the unit is energized, injecting the waste liquid into said flame for burning therein so that combustion products produced thereby fall towards the bottom of the first chamber and pass through the passage from the first chamber into the second chamber, and a second burner for, when the unit is energized, burning combustion products exiting from the passage into the second chamber.

The first chamber preferably includes a floor made of a smooth refractory material for assisting in directing the combustion products through the passage and for providing supplemental volatilization of any liquids impinging thereon.

In an advantageous embodiment, the apparatus includes a delivery and recirculation pump for, responsive to a signal produced by the sensor means when the level of waste liquids within the reservoir reaches a further, lower predetermined value, providing recirculation of the waste liquid within the reservoir and maintaining a predetermined pressure on the waste liquid in a supply pipe connected to the injection means.

In accordance with a further advantageous feature of the invention, the burner unit comprises a hinged access door or plate in one wall thereof for, when pivoted to an open position, permitting access to the interior of the unit for inspection and cleaning purposes. The access door is preferably located in a top wall of the burner unit above the first chamber, and the first burner is mounted on the access door. To this end, the first burner is provided with flexible or detachable connections thereto for enabling pivoting of the first burner along with the access door. Preferably, the access door includes seal means for providing an airtight seal between the access door and the corresponding opening in the top wall of the burner unit.

The apparatus preferably further comprises piping for connecting the injection means to a source of compressed air so that compressed air from the source is supplied along with the waste liquid to the injection means to provide atomizing of the waste liquid injected into the flame produced by the first burner.

Advantageously, the burner further comprises air blower means for, when energized, providing purging of the first and second chambers. This air blower means preferably includes separate air ducts respectively connected to the first and second chambers through the associated burners.

Preferably, the apparatus further comprises a temperature control means for individually controlling the temperatures within the two chambers. The temperature control means advantageously includes a first temperature sensor for monitoring the temperature within the first chamber and a second temperature sensor for monitoring the temperature within the second chamber. In addition, the temperature control means preferably comprises first and second fuel control valve means for modulating the amount of fuel supplied to the first and second burners, respectively, responsive to the outputs of said first and second temperature sensors.

In a preferred embodiment, the burner unit comprises a metal housing, a ceramic heat insulating lining for the internal walls of the housing, and a partition dividing the housing into said first and second chambers and comprising a ceramic temperature insulating material. The partition includes an opening therein defining the passage between the chambers.

Other features and advantages of the invention will be set forth in, or apparent from, the following detailed description of preferred embodiments of the invention.

DESCRIPTION OF THE PREFERRED EMBODIMENTS

Figure 1:
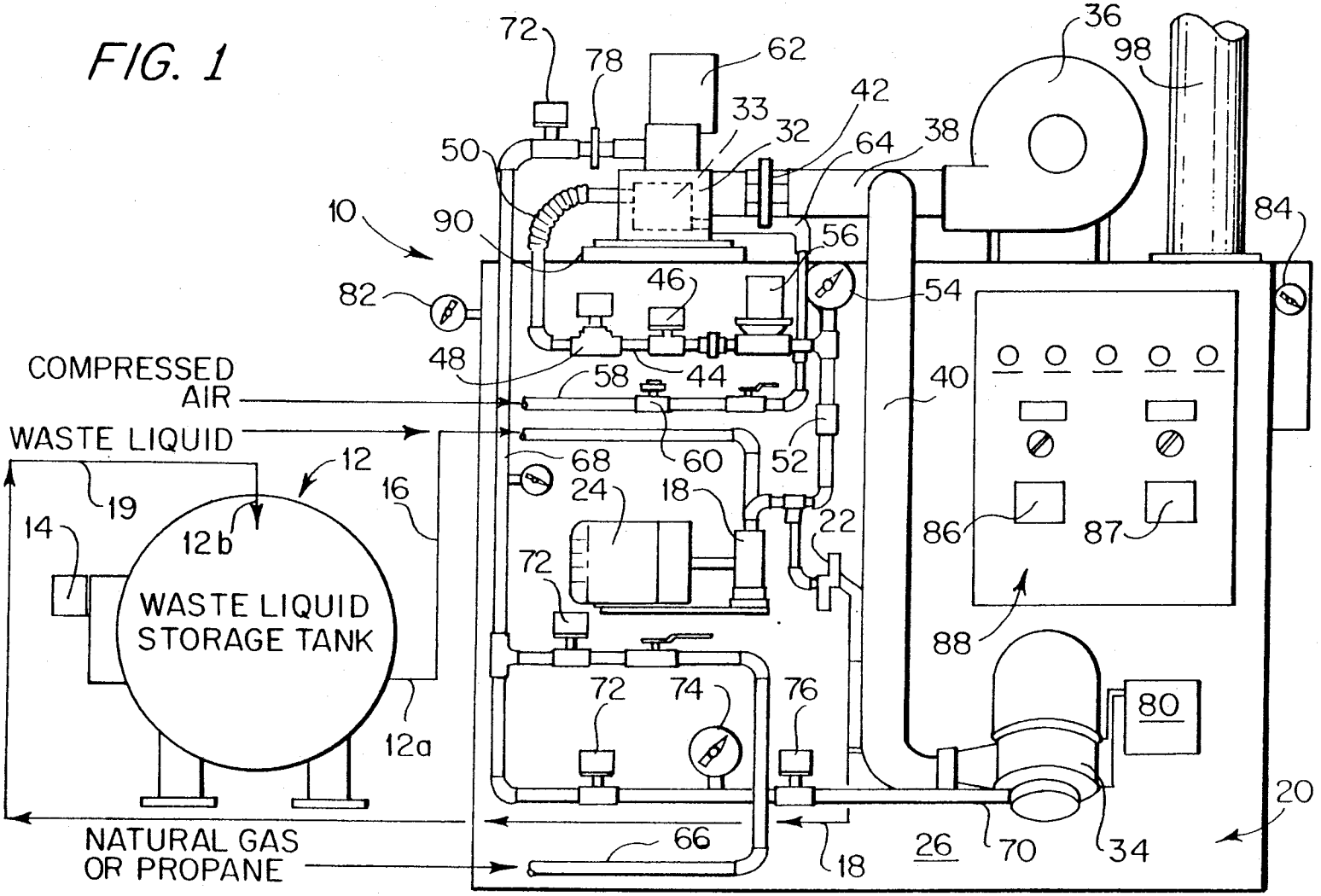
FIG. 1 is a schematic front elevational view of a waste liquid disposal apparatus constructed in accordance with a preferred embodiment of the invention.

Referring to FIG. 1, there is shown a schematic front elevational view of a waste liquid disposal apparatus constructed in accordance with an exemplary embodiment of the invention. The apparatus, which is generally denoted 10, includes a waste liquid storage tank or reservoir 12 for storing waste liquids to be disposed of and including a level switch 14 that is actuated when the height of the waste liquid in the reservoir defined by tank 12 reaches a preset level. An inlet or delivery pipe 16 connects an outlet 12*a* of tank 12 to a delivery and recirculation pump 18 associated with the main destruction or disposal (burner) unit 20 while a recirculation pipe 19 is connected from pump 18 through a back pressure relief valve 22 back to an inlet 12*b* in tank 12. The delivery pump assembly also includes a pump motor 24 and, when pump 18 is energized in response to activation of level switch 14, pump 18 recirculates liquid in the tank 12 and maintains a preset pressure level in the supply piping.

Figure 3:
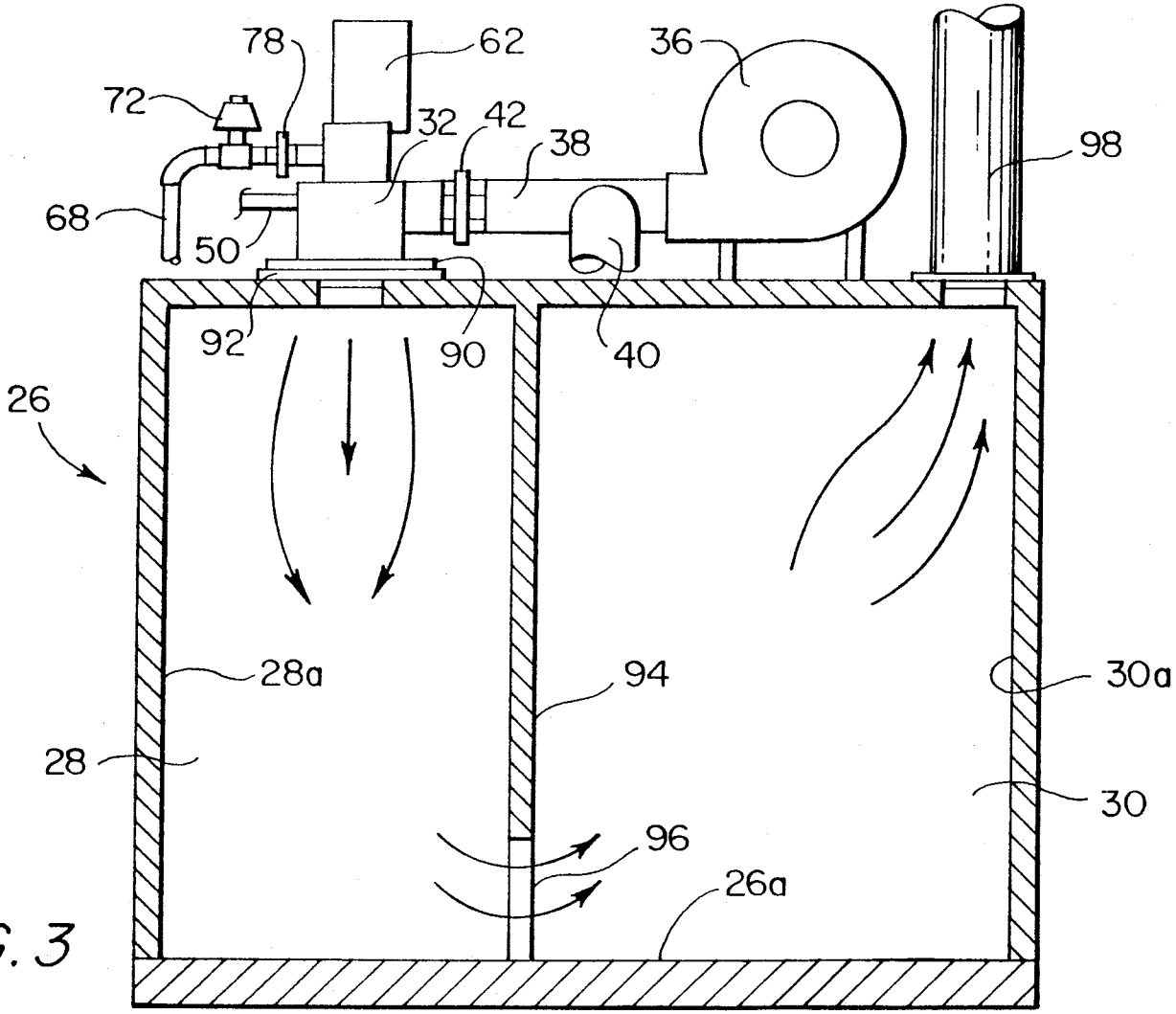
FIG. 3 is a cross sectional view, with some parts omitted, of the burner unit of FIG. 1.

Unit 20 includes a generally rectangular housing 26 which is divided into first and second chambers 28 and 30 (see FIG. 3). A first burner 32, including a built-in injection nozzle indicated schematically at 33, is mounted on the top of housing 26 and serves, inter alia, to control the temperature of chamber 28 while a second burner 34 is mounted in the front wall of housing 26 and serves, inter alia, to control the temperature of chamber 30. In an exemplary embodiment, burner 32 comprises a Maxon 508 burner and nozzle 33 is, as stated, built into the burner although other burner and injector arrangements, including those employing separate injectors, can be used. Although burner 32 is shown as being downwardly fired in the illustrated embodiment, the burner 32 can, for example, be horizontally fired in an alternative embodiment.

An air fan 36, mounted on the top of housing 26 and including an associated motor 36*a*, provides for automatic purging of chambers 28 and 30 by providing a purging air flow via air ducts 38 and 40 connected to burners 32 and 34, respectively. A detachable pipe union 42 connects duct 38 to burner 32.

Waste liquid from tank 12 is pumped by pump 18 through pipe connection 44 to injection nozzle 33 of burner 32 via a pressure switch 46 and a waste liquid valve 48 included in pipe connection 44. Pipe connection 44 also includes a flexible detachable section 50 connected to burner 32. In addition, a manual valve 52, a pressure gauge 54 and a pressure regulator 56 can also be included as illustrated.

Compressed air is supplied from a suitable source (not shown) by a pipe connection 58 which includes an atomizing air valve 60 which is connected to injection nozzle 33 of burner 32. A modulating fuel valve 62 is also connected to burner 32 for controlling the amount of fuel supplied to injector 33. Pipe connection 58 includes a flexible detachable connector portion 64.

A suitable fuel, such as liquid petroleum (LP), natural gas or No. 2 oil, is supplied from a source (not shown) by a pipe connection 66 including a first branch 68 connected to first burner 32 and a second branch 70 connected to second burner 34. A series of fuel shut-off valves 72 are connected in pipe connection 66 along with a pressure gauge 74 and a pressure switch 76. Branch connection 68 is connected to burner 32 via a detachable union 78. A modulating fuel valve 80 (similar to modulating valve 62) is connected to burner 34 and serves to control the fuel supplied to burner 34.

The temperatures within chambers 28 and 30 are monitored by respective thermocouples 82 and 84 which supply corresponding input signals to respective temperature controllers 86 and 87 mounted on a combustion control panel 88 located on the front of housing 26.

Figure 2:
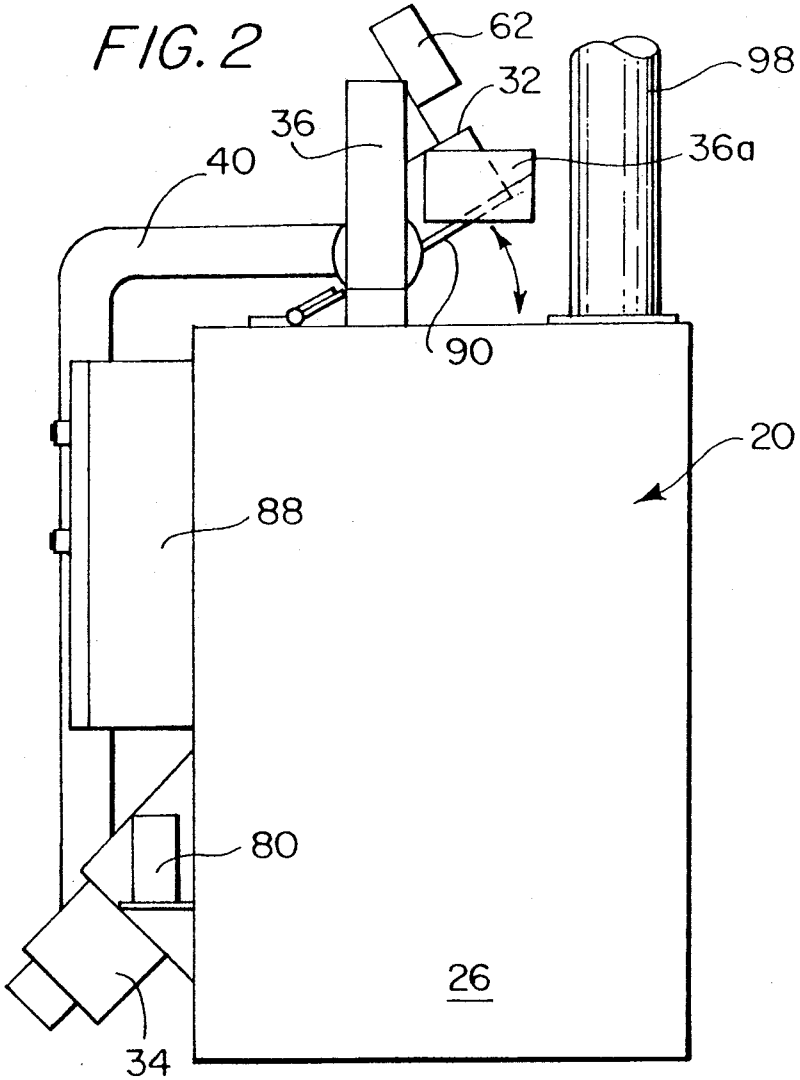
FIG. 2 is a side elevational view of the burner unit of the apparatus of FIG. 1.

As best can be seen in FIGS. 2 and 3, burner 32 and associated fuel modulator valve 62, which together constitute a waste injection burner unit or assembly, are mounted on a hinged plate or access door 90 which forms part of the upper wall of housing 26 and which is hinged so as to permit pivoting or swinging away of this burner unit to thus enable cleaning and inspection of the chamber. The plate 90 includes a gasket 92 which provides sealing during operation. The flexible connector portion 64 of compressed air line 58 and the flexible connector portion 50 of waste liquid pipeline connection 44 are preferably constructed of stainless steel flexible hose of sufficient length and flexibility to allow the burner unit to swing away. Similarly, the combustion air pipe union 42 and the primary fuel pipe union 78 can be disconnected so as to enable this swinging away of the burner unit so as to permit cleaning and inspection as described above.

Figure 4:
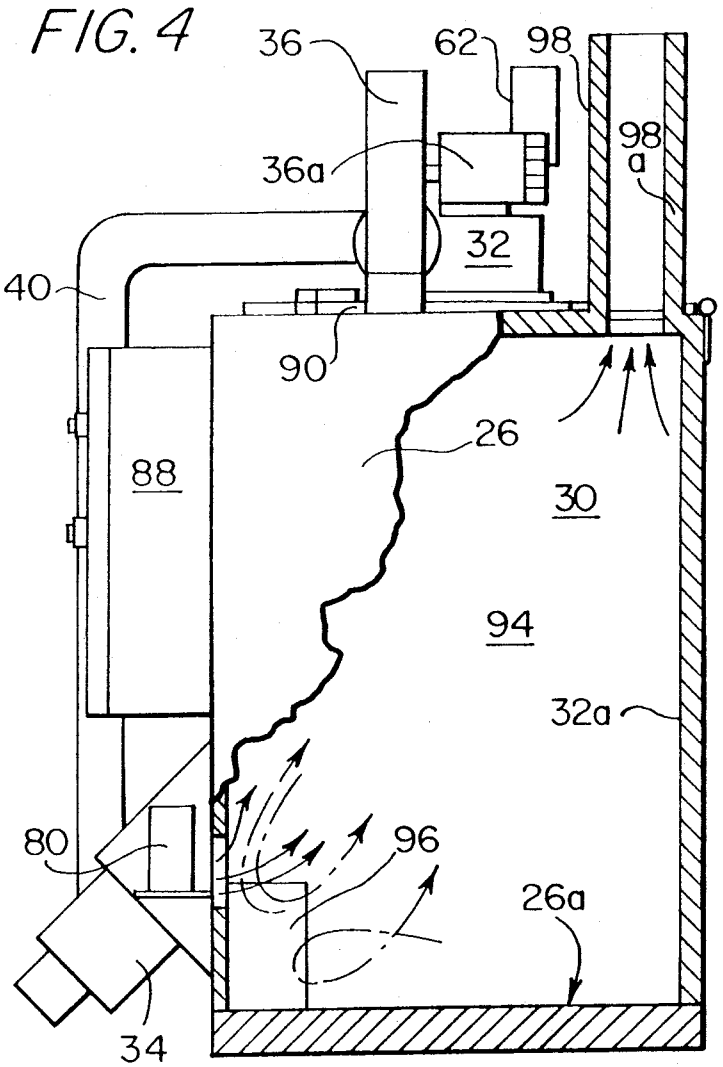
FIG. 4 is a side elevational view corresponding to that of FIG. 2 but partially broken away to show the interior of the second chamber.

Chambers 28 and 30 are formed by a vertical dividing wall 94 which is disposed within housing 26 and which includes a front edge spaced from the bottom wall or floor 26*a* of housing 26 so as to define a lower rectangular opening or passage 96 (see FIG. 4) also referred to herein as a flame port. The dividing wall 94 is preferably fabricated entirely of vacuum cast ceramic refractory material.

Housing 26 which is preferably of steel construction, has the internal walls thereof lined with linings 28*a* and 30*a*, respectively, fabricated out of a vacuum formed ceramic insulating material such as a lightweight vacuum cast ceramic fiber. The floor 26*a* of housing 26 (and thus of chambers 28 and 30) is preferably fabricated of monolithically cast high refractory material. The purpose of this construction is to provide a suitable abrasion resistant surface for the turning or redirecting of the gases into the secondary chamber 30 as described in more detail below. An exhaust pipe or chimney 98 having a lining 98a of a refractory material is mounted on the top of housing 26 in communication with the second chamber 30.

Considering the overall operation of the apparatus described above, waste liquids to be destroyed are placed in the reservoir defined by tank 12 and the delivery pump 18 is energized when these liquids reach the preset level in the tank 12 determined by level switch 14. Upon energization thereof, pump 18 recirculates the liquids in the tank 12 and maintains a predetermined pressure in the supply piping (including connector pipe 44) for delivering the liquids to the first, waste liquid burner 32. When the liquids level reaches a higher preset level (also determined by level switch 14) a signal is provided to the control panel 88 of the waste liquid destruction (burner) unit 20 and the unit 20 automatically begins its start sequence. As part of this start sequence, the combustion chambers 28 and 30 are automatically purged by air flow from the combustion air fan 36 through burners 32 and 34 as described above, and, after purging, both burners 32 and 34 are ignited using fuel (e.g., LP, natural gas or No. 2 oil as explained previously) supplied through branches 68 and 70 and the fuel shut off valves 72 in branches 68 and 70 are opened.

When a predetermined temperature has been achieved in each of the combustion chambers 32 and 34, as monitored by thermocouples 82 and 84, the waste liquid valve 48 is opened and the atomizing air valve 44 is also opened and liquids will be atomized and injected into the flame produced by waste liquid burner 32 through the air atomizing injector 33 (which, as noted above, is part of burner 32 in a conventional construction). The operation is such that the fuel flame produced by burner 32 is maintained. The line pressure of the waste liquid and primary fuel is monitored by pressure switches 46 and 76.

As noted above, the temperatures in the two chambers 28 and 30 are monitored by thermocouples 82 and 84 which supply corresponding signals to temperature controllers 86 and 87 of control panel 88. Controllers 86 and 87 govern the operation of modulating fuel valves 62 and 80 which, in turn, control the input of the fuel to the respective burners 32 and 34. The temperatures of the gases in the primary chamber 28 and secondary chamber 30 are controlled so as to be maintained at about 1200° F. and 1800° F., respectively, in accordance with a preferred non-limiting embodiment of the invention.

The combustion products produced by the waste injection burner 32 travel downwardly in chamber 28 as indicated in FIG. 3 and ultimately pass through the flame port 96 into the secondary chamber 30. The gases passing into chamber 30 are accelerated and immediately mixed with the flame from the secondary burner 34 so that any volatilized or partially combusted materials are burned. The flame port 36 is sized to provide such acceleration of the gases passing into secondary chamber 30 which thereby further improves mixing. Burner 34 is positioned relative to the flame port 96 such that the flame from burner 34 is directed to entrain gasses exiting port 96 into the flame pattern of the burner 34. Particles from the liquid injection burner 32 that are not turned or redirected so as to pass through port 96 will impact against, and be combusted on, the radiant solid refractory floor 26a of housing 26. Thus, as explained above, floor 26 provides a suitable abrasion resistant surface for redirecting the gases through port 96 into chamber 30 as well as provides for the supplemental destruction or volatilization of any liquids which impinge on this surface.

The operation of unit 20 will continue in the manner described above until the level in tank 12 has dropped below a preset level at which time a signal from switch 14 will cause the operation of unit 20 to cease and the unit 20 will be automatically shut down.

It will be apparent from the foregoing that the apparatus of the present invention enables waste oil and other fluids in widely varying concentrations (from 100% hydrocarbons to 100% water) to readily be destroyed, and thus it will be appreciated that the invention represents an economical way in which to provide on-site destruction of such fluids, particularly as contrasted with conventional approaches requiring the costly transporting of these materials to large commercial incinerators for burning.

It will also be appreciated that modifications or additions can be made in the apparatus described above and it is noted that, in an alternative embodiment, a heat exchanger and burner can be added to the secondary section of the apparatus so as to enable the use of the heated gas produced thereby in space heating. Thus, although the present invention has been described relative to specific exemplary embodiments thereof, it will be understood by those skilled in the art that variations and modifications can be effected in these exemplary embodiments without departing from the scope and spirit of the invention.

What is claimed is:

1. An apparatus for providing on-site destruction of waste liquids such as liquid anti-freeze, waste motor oil, and the like independently of the liquid concentration thereof, said apparatus comprising:

a storage tank for waste liquid including a reservoir and level sensing means for sensing the level of the waste liquid in the reservoir; and a burner unit energized responsive to said level sensing means when the level of said waste liquid exceeds a predetermined value and including a first chamber, a second chamber in communication with the first chamber, means defining a passage between said chambers disposed at the bottom of said chambers, a first burner located at the top of the first chamber for, when said unit is energized, producing a flame which is projected into said first chamber, injection means for, when said unit is energized, injecting the waste liquid into said flame for burning therein so that combustion products produced thereby fall towards the bottom of said first chamber and pass through said passage from said first chamber into said second chamber, and a second burner for, when said unit is energized, burning combustion products exiting from said passage into said second chamber.

2. An apparatus as claimed in claim 1 wherein said first chamber includes a floor made of a smooth refractory material for assisting in directing the combustion products through said passage and for providing supplemental volatilization of any liquids impinging thereon.

3. An apparatus as claimed in claim 1 wherein said apparatus includes delivery and recirculation pump means for, responsive to a signal produced by said sensor means when the level of waste liquids within said reservoir reaches a further, lower predetermined value, providing recirculation of the waste liquid within said reservoir and maintaining a predetermined pressure on the waste liquid in a supply pipe connected to said injection means.

4. An apparatus as claimed in claim 1 wherein said burner unit comprises a hinged access door in one wall thereof for, when pivoted to an open position, permitting access to the interior of said unit.

5. An apparatus as claimed in claim 4 wherein said access door is located in a top wall of said unit above said first chamber and said first burner is mounted on said access door.

6. An apparatus as claimed in claim 5 wherein said access door includes seal means for providing an airtight seal between the access door and said unit.

7. An apparatus as claimed in claim 5 wherein said first burner includes flexible or detachable connections thereto for enabling pivoting of said first burner with said access door.

8. An apparatus as claimed in claim 1 wherein said apparatus further comprises piping means for connecting said injection means to a source of compressed air so that compressed air from the source is supplied along with the waste liquid to the injection means to provide atomizing of the waste liquid injected into the flame produced by the first burner.

9. An apparatus as claimed in claim 1 further comprising air blower means for, when energized, providing purging of said first and second chambers.

10. An apparatus as claimed in claim 9 wherein said air blower means includes separate air ducts respectively connected to the first and second chambers through the associated burners.

11. An apparatus as claimed in claim 1 further comprising temperature control means for individually controlling the temperatures within said chambers.

12. An apparatus as claimed in claim 11 wherein said temperature control means includes a first temperature sensor for monitoring the temperature within said first chamber and a second temperature sensor for monitoring the temperature within said second chamber.

13. An apparatus as claimed in claim 12 wherein said temperature control means further comprises first and second fuel control valve means for modulating the amount of fuel applied to said first and second burners, respectively, responsive to the outputs of said first and second temperature sensors.

14. An apparatus as claimed in claim 1 wherein said burner unit comprises a metal housing, a ceramic heat insulating lining for the interior walls of said housing, and a partition dividing the housing into said first and second chambers and comprising a ceramic temperature insulating material, said partition including an opening therein defining said passage between said chambers.

15. An apparatus for providing on-site destruction of waste liquids such as liquid anti-freeze, waste motor oil, and the like, said apparatus comprising: a storage tank for waste liquid; and a burner unit connected to said storage tank for burning waste liquid supplied from said storage tank; said burner unit comprising first and second chambers, means defining a passage between said chambers, a first burner connected to a source of fuel for producing a flame, injection means connected to said storage tank and to a source of atomizing air for injecting waste liquid in an atomized form into said flame for burning therein so that combustion products are produced in said first chamber and pass through said passage from said first chamber to said second chamber, and a second burner connected to said source of fuel for burning combustion products exiting from said passage into said second chamber.

16. An apparatus as claimed in claim 15 wherein said passage is located in a common wall between said chambers at the bottom of said chambers and is of a size such as to provide acceleration of combustion products passing therethrough.

17. An apparatus for providing on-site destruction of waste liquids such as liquid anti-freeze, waste motor oil, and the like, said apparatus comprising: a storage tank for waste liquid including a reservoir for the waste liquid and level sensing means for sensing the level of the waste liquid in the reservoir; and a burner unit to which waste liquid is supplied from said tank responsive to said level sensing means when the level of the waste liquid in the reservoir exceeds a predetermined value; said burner unit including a first chamber, a second chamber in communication with the first chamber through a passage between said chambers disposed at the bottom of said chambers, a first burner for producing a flame for burning waste liquid, injection means for injecting waste liquid supplied from said tank into said flame for burning therein so that combustion products produced thereby fall towards the bottom of said first chamber and pass through said passage into said second chamber, and a second burner for producing a flame in said second chamber for burning combustion products exiting from said passage into said second chamber.

18. An apparatus as claimed in claim 17 wherein said injection means comprises atomizing injection means, connected to a source of compressed air and to said storage tank, for injecting waste liquid from said storage tank in a atomized form into the flame produced by the first burner.

19. An apparatus as claimed in claim 17 wherein at least said first chamber includes a floor made of a smooth refractory material for assisting in directing the combustion products through said passage and for providing supplemental volatilization of any liquids said floor.

20. An apparatus as claimed in claim 17 wherein said apparatus includes delivery and recirculation pump means for, responsive to a signal produced by said sensor means when the level of waste liquids within said reservoir reaches a further, lower predetermined value, providing recirculation of the waste liquid within said reservoir and maintaining a predetermined pressure on the waste liquid in a supply pipe connected to said injection means.

21. An apparatus as claimed in claim 17 comprising means for supplying a burner fuel to said first and second burners.

22. An apparatus as claimed in claim 17 further comprising air blower means for purging said chambers by providing an air flow through first and second burners.

23. An apparatus as claimed in claim 17 further comprising temperature control and monitoring means for monitoring the temperatures within each of said chambers and for maintaining the temperature in each chamber at a preset level.

24. An apparatus as claimed in claim 17 wherein said chambers include an inner lining of a ceramic heat insulating material.

25. An apparatus as claimed in claim 17 wherein said burner unit further comprises a hinged plate on which said first burner is mounted so as to permit the plate to be pivoted to an open position that permits access to the first chamber.

* * * * *